US009891030B1

(12) United States Patent
Kley

(10) Patent No.: US 9,891,030 B1
(45) Date of Patent: Feb. 13, 2018

(54) MOLDED PLASTIC CARTRIDGE WITH EXTENDED FLASH TUBE, SUB-SONIC CARTRIDGES, AND USER IDENTIFICATION FOR FIREARMS AND SITE SENSING FIRE CONTROL

(71) Applicant: Victor B. Kley, Berkeley, CA (US)

(72) Inventor: Victor B. Kley, Berkeley, CA (US)

( * ) Notice: Subject to any disclaimer, the term of this patent is extended or adjusted under 35 U.S.C. 154(b) by 0 days.

(21) Appl. No.: 15/289,924

(22) Filed: Oct. 10, 2016

Related U.S. Application Data

(62) Division of application No. 14/203,440, filed on Mar. 10, 2014, now Pat. No. 9,470,485.

(60) Provisional application No. 61/787,459, filed on Mar. 15, 2013.

(51) Int. Cl.
*F42B 5/30* (2006.01)
*F42B 33/00* (2006.01)

(52) U.S. Cl.
CPC ..... *F42B 5/30* (2013.01); *F42B 33/001* (2013.01)

(58) Field of Classification Search
CPC ... F42B 5/26; F42B 5/30; F42B 5/313; B21K 21/04; B21K 21/08; B21K 21/02
USPC ..... 102/464–467
See application file for complete search history.

(56) References Cited

U.S. PATENT DOCUMENTS

| | | | |
|---|---|---|---|
| 123,352 | A | 2/1872 | Milbank |
| 2,041,253 | A | 5/1936 | Leussler |
| 2,177,928 | A | 10/1939 | Knudsen |
| 2,336,065 | A | 12/1943 | Cadham |
| 2,654,319 | A | 10/1953 | Roske |
| 2,759,419 | A | 8/1956 | Hitchens et al. |
| 2,862,446 | A | 12/1958 | Ringdal |
| 2,918,868 | A | 12/1959 | Ringdal |
| 2,970,905 | A | 2/1961 | Doll |
| 2,987,775 | A | 6/1961 | Albrecht et al. |
| 2,995,090 | A | 8/1961 | Daubenspeck |
| 3,026,802 | A | 3/1962 | Barnet et al. |
| 3,031,966 | A | 5/1962 | Metzger |
| 3,099,958 | A | 8/1963 | Daubenspeck et al. |

(Continued)

FOREIGN PATENT DOCUMENTS

| | | | |
|---|---|---|---|
| CH | 326592 | A | 12/1957 |
| DE | 2419881 | A1 | 12/1974 |

(Continued)

OTHER PUBLICATIONS

"ASTM F2094 $Si_3N_4$ Cerbec Ball Specifications," Saint-Gobain Ceramics, downloaded from http://www.cerbec.com/TechInfo/TechSpec.asp on Feb. 8, 2005, 3 pages.

(Continued)

*Primary Examiner* — Samir Abdosh
(74) *Attorney, Agent, or Firm* — Kilpatrick Townsend & Stockton, LLP

(57) ABSTRACT

Cartridges for firearms are created with extended flash tubes to ignite the propellant efficiently from base of the projectile to the interior rear of the cartridge case. Some firearms include a specially designed trigger and microphone capable of verifying a user's identity so that only an authorized user can discharge the firearm. Some firearms include a GPS sensor, World Time RF sensor, and stored updatable list of times, GPS coordinates, distances from the GPS coordinates such that the firearm is disabled for use in these restricted areas.

21 Claims, 6 Drawing Sheets

(56) References Cited

U.S. PATENT DOCUMENTS 3,123,003 A 3/1964 Lange, Jr. et al.
3,144,827 A 8/1964 Boutwell
3,257,948 A * 6/1966 Axelrod ..... F42B 5/192 102/465
3,292,492 A 12/1966 Sturtevant
3,340,809 A 9/1967 Stadler et al.
3,424,089 A 1/1969 Humpherson
3,491,423 A 1/1970 Haller
3,559,581 A 2/1971 Kriz et al.
3,628,225 A 12/1971 Parker
3,659,528 A 5/1972 Santala
3,745,924 A 7/1973 Scanlon
3,786,755 A 1/1974 Eckstein et al.
3,797,396 A 3/1974 Reed
3,842,739 A 10/1974 Scanlon et al.
3,874,294 A 4/1975 Hale
3,935,816 A 2/1976 Boquette, Jr.
3,955,506 A 5/1976 Luther et al.
3,977,326 A 8/1976 Anderson et al.
3,990,366 A 11/1976 Scanlon
4,020,763 A 5/1977 Iruretagoyena
4,023,465 A 5/1977 Inskip
4,054,637 A 10/1977 Gruaz
4,057,168 A 11/1977 Bosshold
4,140,058 A 2/1979 Ballreich et al.
4,147,107 A 4/1979 Ringdal
4,149,465 A 4/1979 Verkozen
4,150,089 A 4/1979 Linet
4,170,071 A 10/1979 Mann et al.
4,187,271 A 2/1980 Rolston et al.
4,192,233 A 3/1980 Dumortier
4,216,722 A 8/1980 Angell
4,323,420 A 4/1982 Masnari et al.
4,325,190 A 4/1982 Duerst
4,390,567 A 6/1983 Liepins
4,444,717 A 4/1984 de Breze
4,455,942 A 6/1984 Murray et al.
4,498,396 A 2/1985 Berube
4,508,036 A 4/1985 Jensen et al.
4,565,131 A 1/1986 Buchner
4,569,288 A 2/1986 Grelle et al.
4,572,078 A 2/1986 Bell
4,593,621 A 6/1986 Buchner
4,614,157 A 9/1986 Grelle et al.
4,624,641 A 11/1986 Gallagher
4,637,520 A 1/1987 Alvi
4,726,296 A 2/1988 Leshner et al.
4,732,364 A 3/1988 Seger et al.
4,738,202 A 4/1988 Hebert
4,809,612 A 3/1989 Ballreich et al.
4,886,177 A 12/1989 Foster
4,913,054 A 4/1990 Petersen
4,928,598 A 5/1990 Sabranski et al.
4,948,371 A 8/1990 Hall
5,021,206 A 6/1991 Stoops
5,033,386 A 7/1991 Vatsvog
5,060,391 A 10/1991 Cameron et al.
5,063,853 A * 11/1991 Bilgeri ..... F42B 5/307 102/444
5,097,768 A 3/1992 Petrovich
5,114,745 A 5/1992 Jones
5,151,555 A 9/1992 Vatsvog
5,215,465 A 6/1993 Marshall et al.
5,237,930 A 8/1993 Belanger et al.
5,239,928 A 8/1993 Ricci
5,259,288 A 11/1993 Vatsvog
5,316,479 A 5/1994 Wong et al.
5,425,299 A 6/1995 Teetzel
5,476,385 A 12/1995 Parikh et al.
5,517,896 A 5/1996 Perrine
5,551,876 A 9/1996 Koresawa et al.
5,563,365 A 10/1996 Dineen et al.
5,602,439 A 2/1997 Valone
5,603,179 A 2/1997 Adams
5,614,942 A 3/1997 Rom
5,616,642 A 4/1997 West et al.
5,667,852 A 9/1997 Kulik et al.
5,708,231 A 1/1998 Koon
5,760,331 A 6/1998 Lowden et al.
5,782,028 A 7/1998 Simon et al.
5,784,821 A 7/1998 Gerard
5,792,556 A 8/1998 Ishikura et al.
5,825,386 A 10/1998 Ohashi
5,858,477 A 1/1999 Veerasamy et al.
5,869,133 A 2/1999 Anthony et al.
5,915,936 A 6/1999 Brentzel et al.
5,937,557 A 8/1999 Bowker
5,937,558 A 8/1999 Gerard
5,969,288 A 10/1999 Baud
6,041,712 A 3/2000 Lyon
6,048,379 A 4/2000 Bray et al.
6,074,454 A 6/2000 Abrams et al.
6,084,340 A 7/2000 Bachmann et al.
6,101,949 A 8/2000 Maucourt et al.
6,110,594 A 8/2000 Pinneo
6,131,519 A 10/2000 Thiesen et al.
6,144,028 A 11/2000 Kley
6,199,286 B1 3/2001 Reed, Jr. et al.
6,210,625 B1 4/2001 Matsushita et al.
6,230,431 B1 5/2001 Bear
6,237,494 B1 5/2001 Brunet et al.
6,252,226 B1 6/2001 Kley
6,257,149 B1 7/2001 Cesaroni
6,257,893 B1 7/2001 Trabut
6,286,240 B1 9/2001 Collins
6,290,726 B1 9/2001 Pope et al.
6,337,479 B1 1/2002 Kley
6,339,217 B1 1/2002 Kley
6,343,140 B1 1/2002 Brooks
6,412,207 B1 7/2002 Crye et al.
6,415,542 B1 7/2002 Bates et al.
6,439,123 B1 8/2002 Dionne et al.
6,481,140 B1 11/2002 Marshall
6,539,874 B2 4/2003 Weise
6,543,365 B1 4/2003 Vasel et al.
6,563,940 B2 5/2003 Recce
6,598,536 B2 7/2003 Burri
6,631,579 B1 10/2003 Lauster et al.
6,652,762 B2 11/2003 Baik et al.
6,663,391 B1 12/2003 Otowa
6,763,126 B2 7/2004 Recce
6,779,461 B1 * 8/2004 Olson ..... F27D 25/006 102/439
6,823,621 B2 11/2004 Gotfried et al.
6,845,716 B2 1/2005 Husseini et al.
6,854,975 B2 2/2005 Ranzinger
6,887,079 B1 5/2005 Robertsson et al.
6,925,742 B1 8/2005 Van Zyl
6,942,486 B2 9/2005 Lvovskiy
6,966,775 B1 11/2005 Kendir et al.
7,036,258 B1 5/2006 Lee et al.
7,132,129 B2 11/2006 Van Enckevort et al.
7,204,191 B2 4/2007 Wiley et al.
7,213,519 B2 5/2007 Wiley et al.
7,281,397 B2 10/2007 Victor
7,363,742 B2 4/2008 Nerheim
7,441,362 B1 10/2008 Kley
7,926,408 B1 4/2011 Kley
8,297,191 B2 * 10/2012 Schaefer ..... F16J 15/025 102/469
8,621,774 B1 1/2014 Kley
8,966,797 B2 3/2015 Carlson
9,032,855 B1 * 5/2015 Foren ..... F42B 33/00 102/466
9,200,880 B1 * 12/2015 Foren ..... F42B 33/02
9,341,425 B2 5/2016 Carlson
9,470,485 B1 10/2016 Kley
2001/0042332 A1 11/2001 Gering
2002/0005138 A1 1/2002 Burri
2002/0014694 A1 2/2002 Olofsson
2002/0112390 A1 8/2002 Harling et al.
2003/0136043 A1 7/2003 Lauster et al.
2003/0163941 A1 9/2003 Herzog
2003/0205958 A1 11/2003 Schwind et al.

(56) References Cited

U.S. PATENT DOCUMENTS

| | | | | |
|---|---|---|---|---|
| 2004/0031180 | A1 | 2/2004 | Ivanov | |
| 2004/0071876 | A1 | 4/2004 | Rakhimov et al. | |
| 2004/0099134 | A1 | 5/2004 | Gotfried et al. | |
| 2004/0146840 | A1 | 7/2004 | Hoover et al. | |
| 2004/0180205 | A1 | 9/2004 | Scarsbrook et al. | |
| 2004/0234860 | A1 | 11/2004 | Qu et al. | |
| 2004/0258918 | A1 | 12/2004 | Chaffin, III | |
| 2006/0040104 | A1 | 2/2006 | Wort et al. | |
| 2006/0048432 | A1 | 3/2006 | Staley, III | |
| 2006/0152786 | A1 | 7/2006 | Takakuwa et al. | |
| 2006/0191182 | A1 | 8/2006 | Curry et al. | |
| 2007/0009860 | A1 | 1/2007 | Young | |
| 2007/0044365 | A1 | 3/2007 | Deken | |
| 2007/0077539 | A1 | 4/2007 | Tzidon et al. | |
| 2007/0084375 | A1 | 4/2007 | Smith | |
| 2007/0089598 | A1 | 4/2007 | Courty | |
| 2007/0104399 | A1 | 5/2007 | Hamza et al. | |
| 2007/0190495 | A1 | 8/2007 | Kendir et al. | |
| 2007/0238073 | A1 | 10/2007 | Portoghese et al. | |
| 2009/0064557 | A1 | 3/2009 | Hughes et al. | |
| 2009/0071055 | A1 | 3/2009 | Kley | |
| 2014/0259841 | A1 | 9/2014 | Carlson et al. | |
| 2015/0153124 | A1 | 6/2015 | Carlson | |
| 2016/0021329 | A1 | 1/2016 | Sakiewicz et al. | |
| 2016/0258701 | A1 | 9/2016 | Carlson et al. | |
| 2017/0089673 | A1* | 3/2017 | Burrow | F42B 5/30 |

FOREIGN PATENT DOCUMENTS

| | | | |
|---|---|---|---|
| EP | 0131863 | A2 | 1/1985 |
| GB | 1015516 | | 1/1966 |
| GB | 2044416 | A | 10/1980 |
| SU | 1045777 | A | 12/1981 |
| TW | 399346 | B | 7/2000 |
| WO | 1988/009476 | A1 | 12/1988 |
| WO | 1989/007498 | A1 | 8/1989 |
| WO | 2003/087699 | A2 | 10/2003 |

OTHER PUBLICATIONS

Biener et al., "Diamond Ablators for Inertial Confinement Fusion," Lawrence Livermore National Laboratory, UCRL-JRNL-213214, 23 pages (2005).

"Bullet" definition, Compact Oxford English Dictionary, downloaded on Feb. 13, 2009 from http://www.askoxford.com/concise_oed/cullet?view=uk, 1 page.

Culver et al., "Velocity and Pressure Effects on Projectiles due to Variation of Ignition Parameters," Naval Postgraduate School, Master of Science in Physics thesis, NTIS No. 757278 (1972), available at http://www.dtic.mil/dtic/tr/fulltext/u2/757278.pdf.

Drory, "Performance of Diamond-Coated Silicon Nitride Bearings," Journal of Spacecraft 34(5): 683-684 (1997).

"Germanium on Silicon Near Infrared Photodetectors," Universita di Roma, downloaded from http://optow.ele.uniroma3.it/optow_2002/Iabs/SiGeNIR%20files/SiGeNIR.htm on Feb. 8, 2005, 12 pages.

Kilkenny et al., "From One-of-a-Kind to 500,000 High Quality Ignition Targets Per Day," Twentieth IAEA Fusion Energy Conference, 9 pages (2004).

Komanduri, "Finishing of Silicon Nitride Balls," Oklahoma State University, downloaded from http://asset.okstate.edu/asset/finish.htm on Oct. 24, 2005, 2 pages.

Martinelli et al., "The Application of Semiconductors with Negative Electron Affinity Surfaces to Electron Emission Devices," Proceedings of the IEEE 62(10): 1339-1360 (1974).

Mikko, "U.S. Military 'Green Bullet': A Technical Report," Association of Firearm and Tool Mark Examiners Journal 31(4) (1999), available at http://www.firearmsid.com/Feature%20Articles/GreenBullets/GreenBullets.htm.

Lindl, "Development of the Indirect-Drive Approach to Intertial Confinement Fusion and the Target Physics Basis for Ignition and Gain," Physics of Plasmas 2(11): 3933-4024.

London et al., "Thermal Infrared Exposure of Cryogenic Indirect Drive ICF Targets," Lawrence Livermore National Laboratory, UCRL-JRNL-213603, 9 pages (2005).

Peterson, "Intertial Fusion Energy: A Tutorial on the Technology and Economics," downloaded from http://www.engineeringpathway.com/engpath/ep/learning_resource/summary/Summary?id=960BAD65-9529-4623-9C5B-891A7651310D, 2 pages.

Peterson, "Output Spectra from Direct Drive ICF Targets," Fusion Technology Institute, University of Wisconsin—Madison, Laser IFE Workshop, available at http://fti.neep.wisc.edu/presentations/rrp_hap10501.pdf, 12 pages (2001).

Singer, "Z Produces Fusion Neutrons, Sandia Scientists Confirm; Announcement to be Made Sunday at APS Meeting," Sandia Lab News 55(7), 16 pages (2003).

Stoldt et al., "Novel Low-Temperature CVD Process for Silicon Carbide MEMS," Department of Chemical Engineering, University of California, Berkeley, 4 pages.

Sullivan et al., "Amorphous Diamond MEMS and Sensors," Sandia National Laboratories, SAND2002-1755, 42 pages. (2002).

"Topic 6.5: Pressure Vessels—Thin Wall Pressure Vessels," Statics & Strength of Material, University of Wisconsin—Stout Physics Department, available at http://www.uwstout.edu/faculty/scotta/upload/Foley-StaticsStrengths.pdf, 4 pages.

U.S. Appl. No. 11/046,526, filed Jan. 28, 2005 by Kley, now abandoned (unpublished; copy available to the Examiner via the U.S. Patent & Trademark Office's IFW system).

U.S. Appl. No. 11/067,517, filed Feb. 25, 2005 by Kley, now abandoned (unpublished; copy available to the Examiner via the U.S. Patent & Trademark Office's IFW system).

"Z Machine Melts Diamond to Puddle," Sandia National Laboratories News Release, 2 pages (2006).

U.S. Appl. No. 14/203,440, filed Mar. 10, 2014, "Notice of Allowance," dated Jun. 6, 2016, 5 pages.

U.S. Appl. No. 14/203,440, filed Mar. 10, 2014, "Non-final Office Action," dated Dec. 11, 2015, 7 pages.

U.S. Appl. No. 15/295,902, "Non-Final Office Action", dated Mar. 3, 2017, 7 pages.

* cited by examiner

MOLDED PLASTIC CARTRIDGE WITH EXTENDED FLASH TUBE, SUB-SONIC CARTRIDGES, AND USER IDENTIFICATION FOR FIREARMS AND SITE SENSING FIRE CONTROL

CROSS REFERENCE TO RELATED APPLICATIONS

This application is a division of U.S. patent application Ser. No. 14/203,440, filed Mar. 10, 2014 for "Molded Plastic Cartridge with Extended Flash Tube, Sub-Sonic Cartridges, and User Identifications for Firearms and Site Sensing Fire Control" (Victor B. Kley), now U.S. Pat. No. 9,470,485 issued Oct. 18, 2016, which claims priority to U.S. Provisional Patent Application No. 61/787,459, filed Mar. 15, 2013 for "Molded Plastic Cartridge with Extended Flash Tube, Sub-Sonic Cartridges, and User Identifications for Firearms and Site Sensing Fire Control" (Victor B. Kley). The entire disclosures of both the above applications are hereby incorporated by reference for all purposes.

This application incorporates by reference the entire disclosures of the following U.S. patents and patent applications for all purposes:

- U.S. Pat. No. 7,441,362, filed Mar. 25, 2005, entitled "Firearm with Force Sensitive Trigger and Activation Sequence" (Victor B. Kley), which claims the benefit of U.S. Provisional Application No. 60/557,470, filed Mar. 29, 2004, entitled "Diamond and/or Silicon Carbide Molding of Small and Microscale or Nanoscale Capsules and Other Objects Including Firearms" (Victor B. Kley); and
- U.S. Pat. No. 7,926,408, filed Nov. 28, 2006, entitled "Velocity, Internal Ballistics and External Ballistics Detection and Control for Projectile Devices and a Reduction in Device Related Pollution" (Victor B. Kley), which claims the benefit of U.S. Provisional Application No. 60/740,586, filed Nov. 28, 2005, entitled "Velocity, Internal Ballistics and External Ballistics Detection and Control for Projectile Devices and a Reduction in Device Related Pollution" (Victor B. Kley).

The present disclosure is related to the following U.S. patent applications, the entire disclosures of which are incorporated by reference for all purposes:

- U.S. patent application Ser. No. 11/046,526, filed Jan. 28, 2005 for "Angle Control of Multi-Cavity Molded Components for MEMS and NEMS Group Assembly" (Victor B. Kley); and
- U.S. patent application Ser. No. 11/067,517, filed Feb. 25, 2005 for "Diamond Capsules and Methods of Manufacture" (Victor B. Kley).

The entire disclosures of the following U.S. Patents are incorporated by reference for all purposes:

- U.S. Pat. No. 4,149,465, issued Apr. 17, 1979, entitled "Ammunition Cartridge" (Jay M. Verkozen);
- U.S. Pat. No. 6,845,716, issued Jan. 25, 2005, entitled "Ammunition Articles with Plastic Components and Method of Making Ammunition Articles with Plastic Components" (Nabil Husseini, David E. Byron);
- U.S. Pat. No. 7,204,191, issued Apr. 17, 2007, entitled "Lead Free, Composite Polymer Based Bullet And Method Of Manufacturing" (Sy Wiley, William E. Rembert, III); and
- U.S. Pat. No. 7,213,519, issued May 8, 1979, entitled "Composite Polymer Based Cartridge Case Having an Overmolded Metal Cup, Polymer Plug Base Assembly" (Sy Wiley, William E. Rembert, III, Gary Loftin).

The following document is incorporated by reference in its entirety for all purposes:

- "Velocity and Pressure Effects on Projectiles due to Variation of Ignition Parameters," Richard Otis Culver, Jr., and Raymond M. Burns, Naval Postgraduate School, Monterey, Calif. (December 1972), Master's thesis, NIST No. 757278 (http://www•dtic•mil/dtic/tr/fulltext/u2/757278•pdf).

BACKGROUND OF THE INVENTION

The present invention relates in general to firearms and ammunition, and in particular to a plastic ammunition cases, ignition control, plastic ammunition cases with ignition control, cases with ignition control and reduced powder volume for sub-sonic ammunition, plastic cases with ignition control and reduced powder volume for sub-sonic bullets, sub-sonic bullets, jet bullets, rocket bullets, mixed rocket/jet bullets and multi-function bullets (including explosive, guided and penetrating), and laser remote steering of low cost projectiles. It also elaborates the safety trigger described in U.S. Pat. No. 7,441,362 and any such trigger like control in any other arrangement.

From shotguns to rifles to handguns, firearms have proven to be a valuable tool for law enforcement and self-defense. Sadly, however, firearms have also proven to be a valuable tool for criminals, who use them to threaten, injure, or murder their victims. In addition, many people are injured or killed each year through accidental discharge of firearms, including children playing with a parent's gun.

Attempts to solve these problems include trigger locks and gun safes. While they are of some help, both solutions are imperfect. Trigger locks and gun safes, for example, keep unauthorized users (particularly children) from operating a firearm, but they can also interfere with legitimate users' ability to respond quickly to a deadly threat. Further, because a criminal can steal a firearm or a gun safe and remove the lock at his or her leisure, trigger locks and gun safes do little to prevent stolen firearms from being used in further crimes.

Plastic cases for firearms, unique and improved projectiles, laser steering, use of plastic cases in place of the common metallic case (brass, plated steel, or steel) have been proven to substantially reduce the weight of a fully loaded round of ammunition. However wear, buildup of powder residue in the action and gas operated components along with heating and accuracy remain problems. In addition in ammunition built to provide low noise, low flash, and meant to launch sub-sonic projectiles (bullets) have very poor accuracy. Erratic cycling of weapons firing sub-sonic cartridges remains a serious problem. Also it is desirable to able to steer a low cost projectile in flight and to initiate acceleration while in flight.

Therefore, it would be desirable to provide firearms with improved protection against unauthorized use, cartridges made with plastic in whole or in part with extended or frontal ignition, rocket and/or jet projectiles (bullets) in which external ballistics can be changed and steered. It also desirable to provide reduced internal volume cartridges, including such reduced volume cartridges with extended flash tubes to initiate ignition at the front of the cartridge proximate to the bullet or projectile.

SUMMARY OF THE INVENTION

Embodiments of the present invention provide ammunition in which all or some of the component parts are made of synthetic materials including plastics, and are made by injection molding.

A preferred embodiment includes a molded in flash tube, or insertable molded flash tube structure such that the ignition gases from the primer at the rear of the cartridge are directed to powder near the front of the cartridge near the bullet In one embodiment, the cartridge is designed to have reduced capacity in addition to an extended molded in flash tube to ignite the powder charge near the base of the bullet at the cartridge neck.

In still further embodiments, the latter two embodiments may include an extended flash tube which has a closure at its end nearest the bullet structured to open when primer ignition sends a pulse of hot gases up the flash tube this permits the powder charge to fill the cartridge case without lodging in the flash tube.

In yet a further embodiment, the full cartridge case interior volume is partially filled with a material such as a plastic foam so as to reduce the volume of the case for reduce powder loads or squib loads, or for sub-sonic cartridges. The filler may also be a sinterable material that can be sintered at temperatures and pressures compatible with the cartridge case materials.

Additionally the filler may be made as two or more layers each layer having a purpose such as producing secondary gases after the bullet moves past the gas port to insure full operation of the gas operated functions of the arm with top and intermediate layers set to block or slow down the production of this secondary gas.

In another preferred embodiment, the firearm includes a specially designed trigger capable of verifying a user's identity so that only an authorized user can discharge the firearm. For example, the firearm can be programmed with a time sequence of pressures (which may vary or remain constant) that a user exerts on the trigger to activate the firearm. In a further embodiment and in conjunction with a piezoelectric structure pressed or attached rigidly to the trigger pressure and vibration may be sent back to the users trigger finger to signal that a pressure stage has been reached, or that ammunition is running low or is out. Further the trigger can be used to set the force for the trigger firing in one or more stages. By feeding back different vibrations other parameters and controls can be set up. All these various programming or setting methods would only occur from set safe conditions.

The following detailed description together with the accompanying drawings will provide a better understanding of the nature and advantages of the present invention.

DESCRIPTION OF SPECIFIC EMBODIMENTS

The related patent applications incorporated by reference above describe, inter alia: various techniques and apparatus for molding plastic cartridge cases (U.S. Pat. No. 7,204,191); and various techniques and apparatus for a pressure sensitive trigger (U.S. Pat. No. 7,441,362). In embodiments of the present invention, such techniques can be used to fabricate cartridges.

Figure 1:
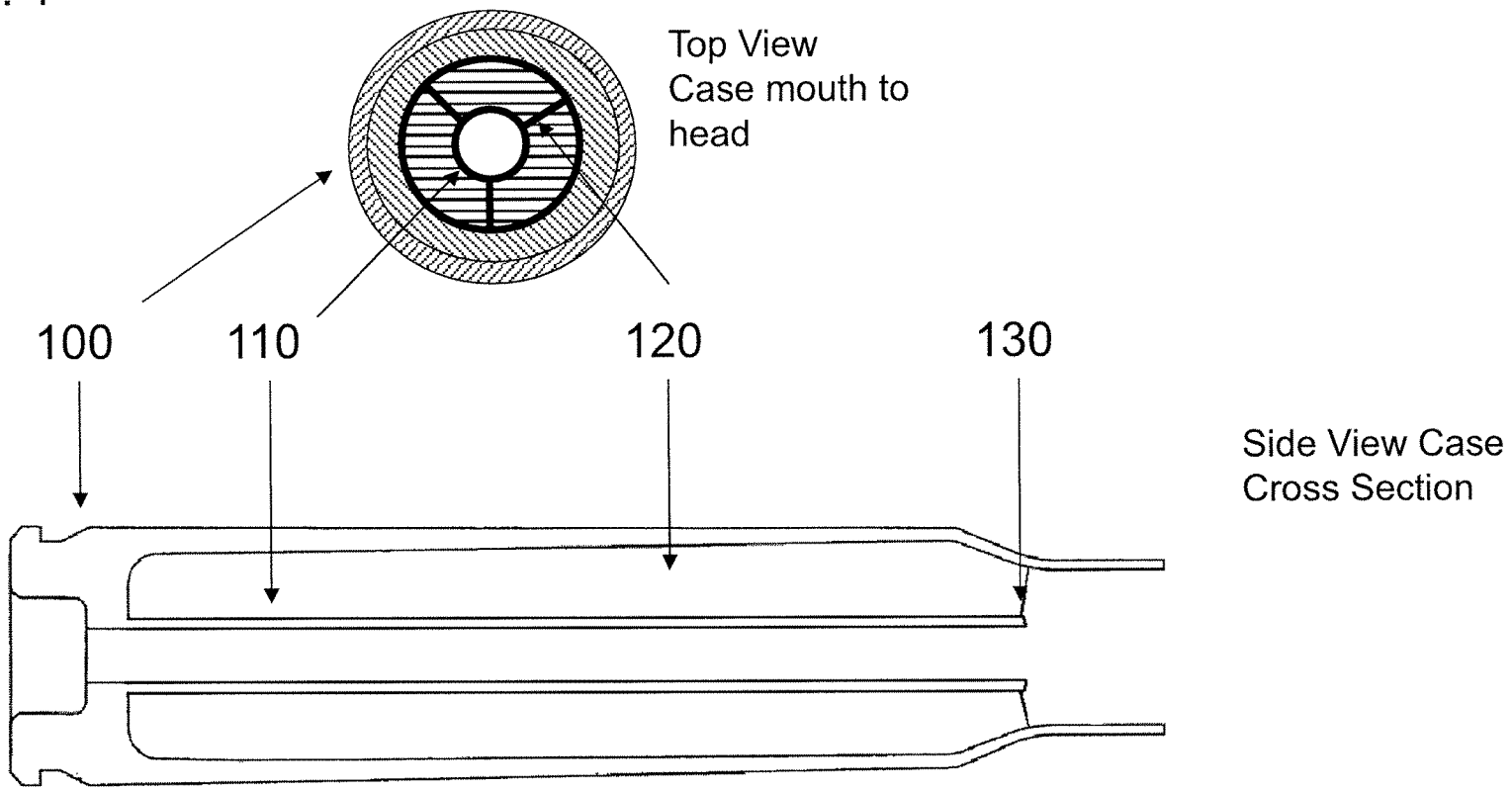
FIG. 1 is a schematic illustration of a cartridge with molded in flash tube.

FIG. 1 shows molded plastic casing 100 with a flash tube 110 and optional support web 120 keeping the flash tube 110 stable. The view is a side cross section and top down (looking from the case mouth where the bullet is seated to the back of the cartridge and primer pocket opening to the flash tube 110). In operation when a standard primer located in the recess at the base of cartridge under the label 100 is struck by the firearm's firing pin (not shown) the hot ignition gases from the pressure sensitive charge in the primer travel through the flash tube 110 to the area 130 near the neck of the cartridge where they cause the slow burning gun powder to ignite from 130 back to the base area. The gases created by the burning gun powder reach high pressures sending the bullet (not shown) out the barrel (not shown).

In an alternative embodiment the cartridge base including the primer recess are made of a rigid material or metal such as brass or steel with the case and flash tube molded from plastic. In yet another embodiment the support web may be one or more ribs supporting the flash tube at the bullet end near 130 and extend partially toward the base in one or more separated segments.

Figure 2:
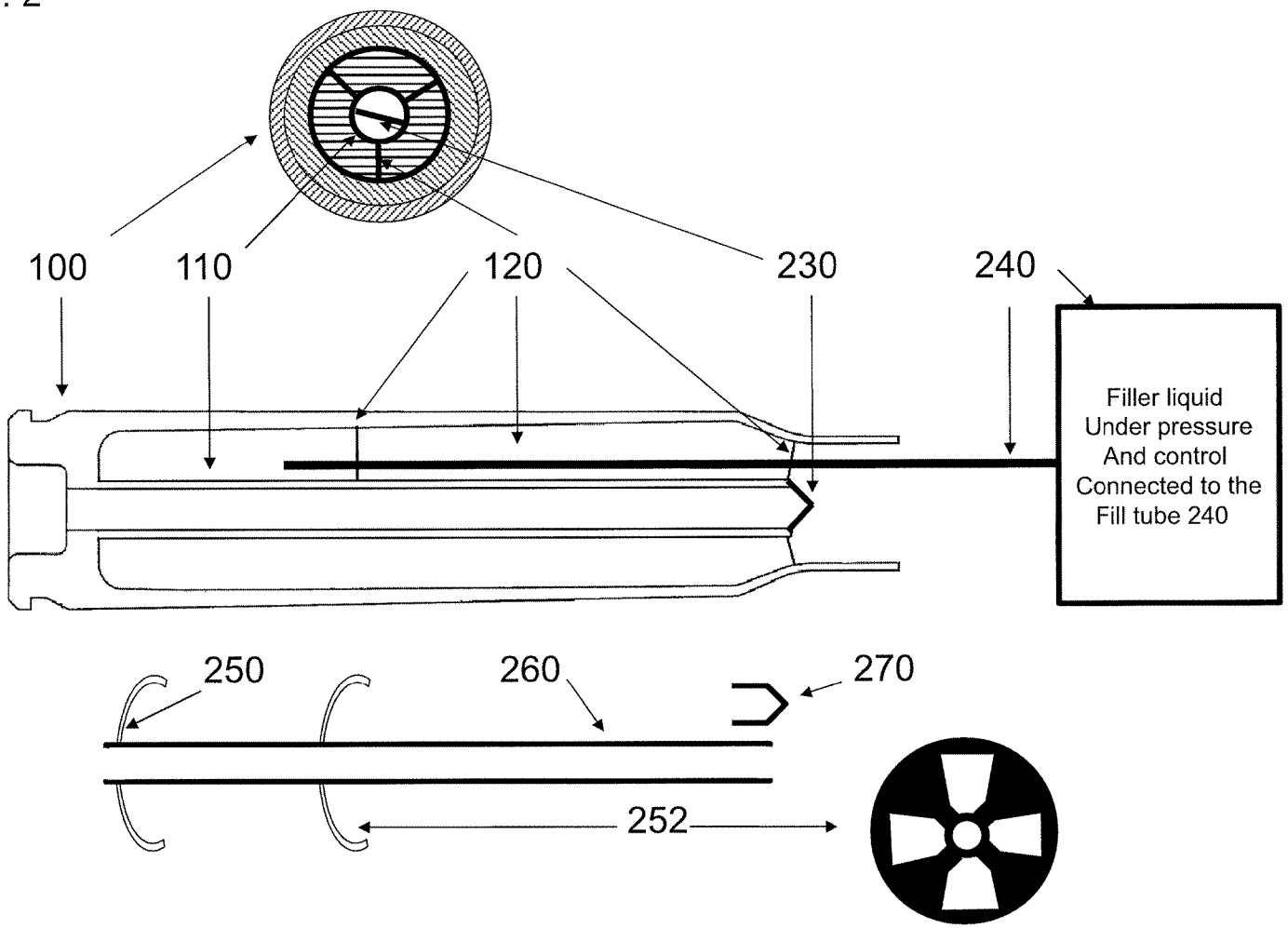
FIG. 2 is two views of a plastic cartridge with flash tube having a closure according to an embodiment of the present invention.

FIG. 2 shows a plastic (or alternatively partial plastic with metal base) cartridge case as in FIG. 1 identical except for parted closure 230 which closes off the flash tube end sufficiently to exclude gun powder. Hot gases from the primer push open 230 and ignite any surrounding gun powder so that powder can be tightly packed near the bullet base without obstructing the flash tube. In another embodiment the support web connecting the flash tube 110 to the case side 120 extends only partially towards the back or cartridge case head. In a further embodiment a filler material such as urethane foam is piped under pressure by assembly and deliver tube 240 to the back of the case in order to form a reduce volume for low power loads such as sub-sonic rounds.

FIG. 2 includes a cross section view and top down view of flash tube and disk (252) assembly 250 through 260 an external flash tube and rear seal 250 (a continuous unbroken disk surface) and one or more centering rings 252 which in combination with tube 260 can be inserted through case neck and seat against the cartridge case head with the rear short section of 260 slipping into the flash hole. 252 includes pass through openings which permit powder and/or filler material to be placed in the rear of the cartridge. This assembly may optionally have a split end 270 which freely opens under pressure from the primer gases to ignite the powder at the front of the case under the seated bullet (not shown). In other embodiments of 250-260 another disk like 250 (continuous and unbroken) can establish the rear of a reduced powder volume without adding any substantial weight the cartridge.

Figure 3:
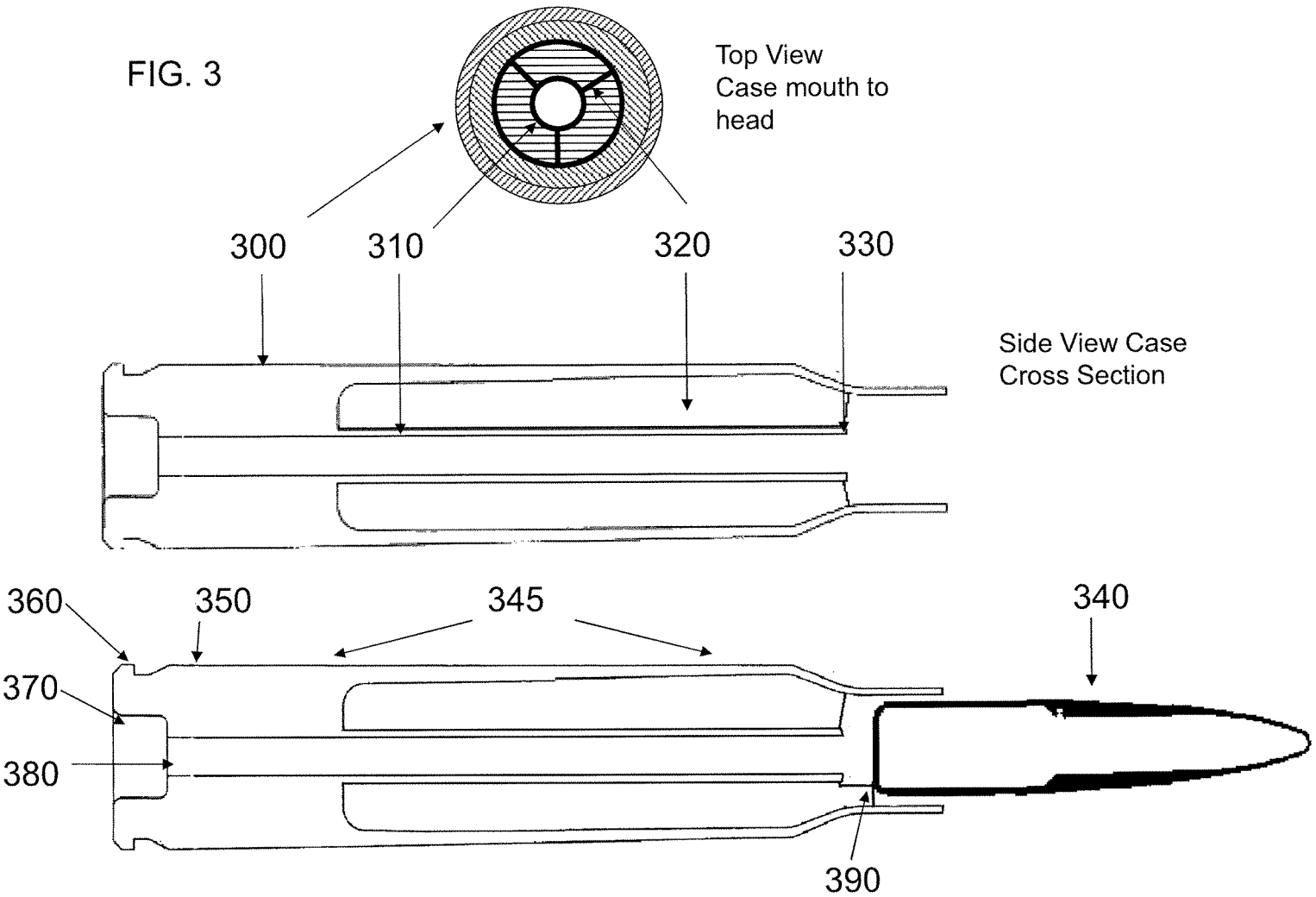
FIG. 3 is three views of a plastic cartridge with reduced powder capacity with flash tube according to an embodiment of the present invention.

FIG. 3 is a side cross section of the cartridge case with bullet 340 and top down case only (looking from the case mouth where the bullet is seated to the back of the cartridge and primer pocket opening to the flash tube 310). This cartridge which may have a metal or other material base or head 360 surrounding the primer with plastic case extending to case mouth molded around it 345 includes a plastic partially extended head or base of the cartridge 300 so as to reduce the capacity of the case.

Figure 4:
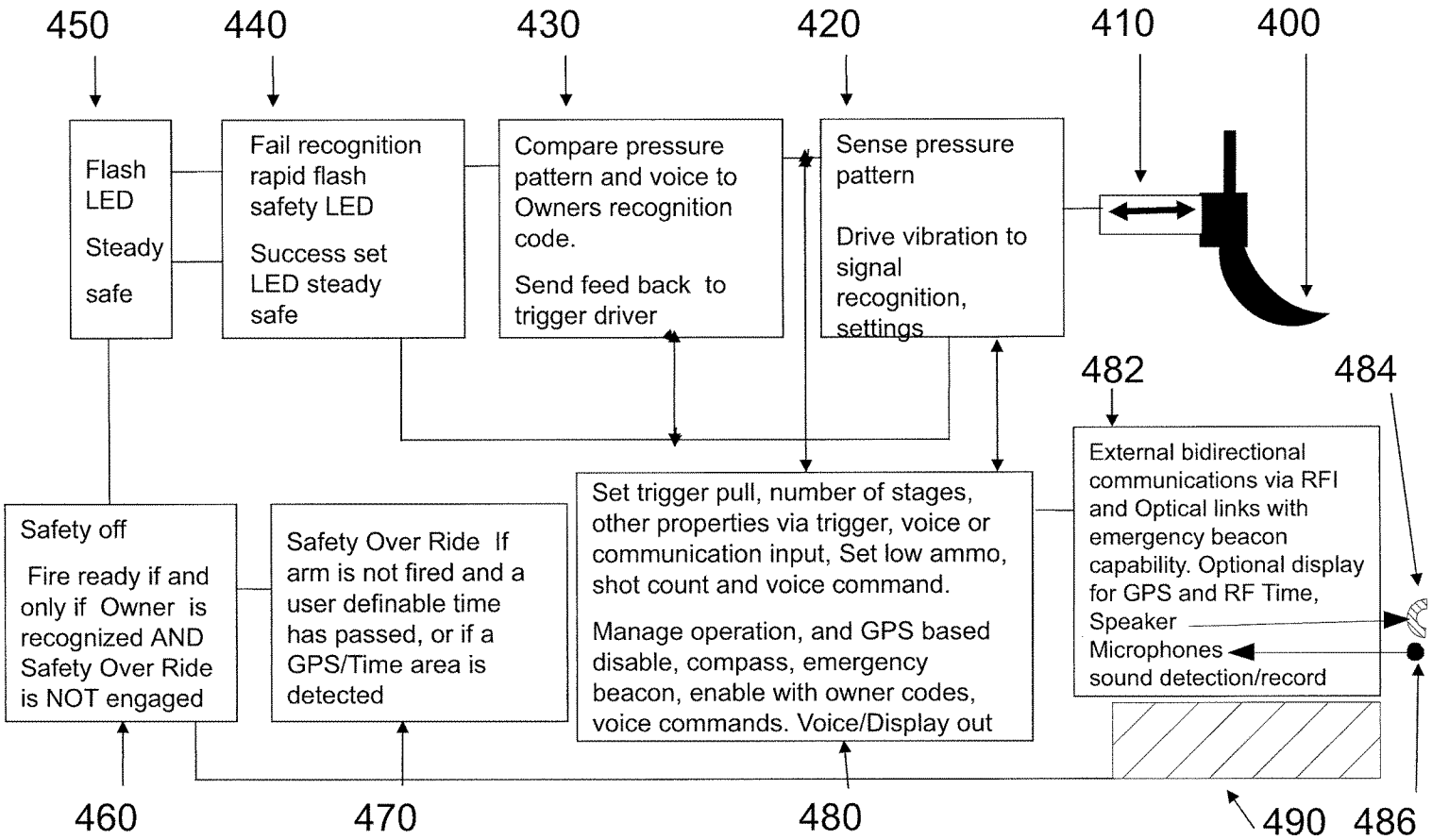
FIG. 4 is a view of a pressure sensitive electronic trigger with vibration feedback according to an embodiment of the present invention.

FIG. 4 shows a schematic and flow chart of the trigger with steel boss 400 and the piezoelectric sensor/transducer 410 proceeding through a logic that culminates in permitting the safety to be placed in the off state and firing the weapon through electromechanical fire mechanism or in an alternative embodiment an electrically ignited cartridge.

Figure 5:
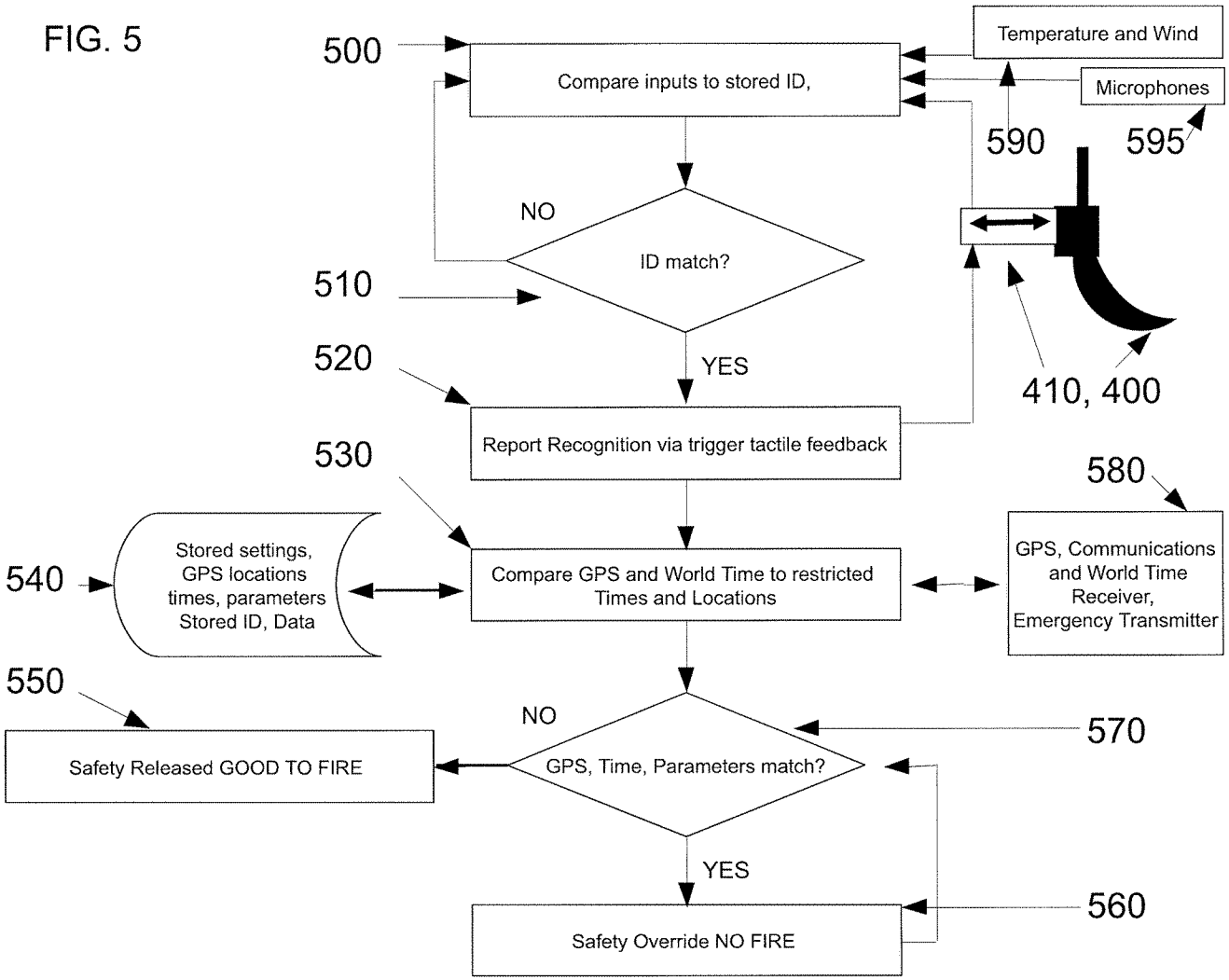
FIG. 5 is a view of a process flow of the electronic trigger with vibration feedback, microphones, global positioning sensor, radio frequency clock sensor, emergency transmitter, temperature and wind speed and direction sensor, and safety according to an embodiment of the present invention.

FIG. 5 shows the process logic as a classic process flow chart which includes most of the embodiments in the invention.

Figure 6:
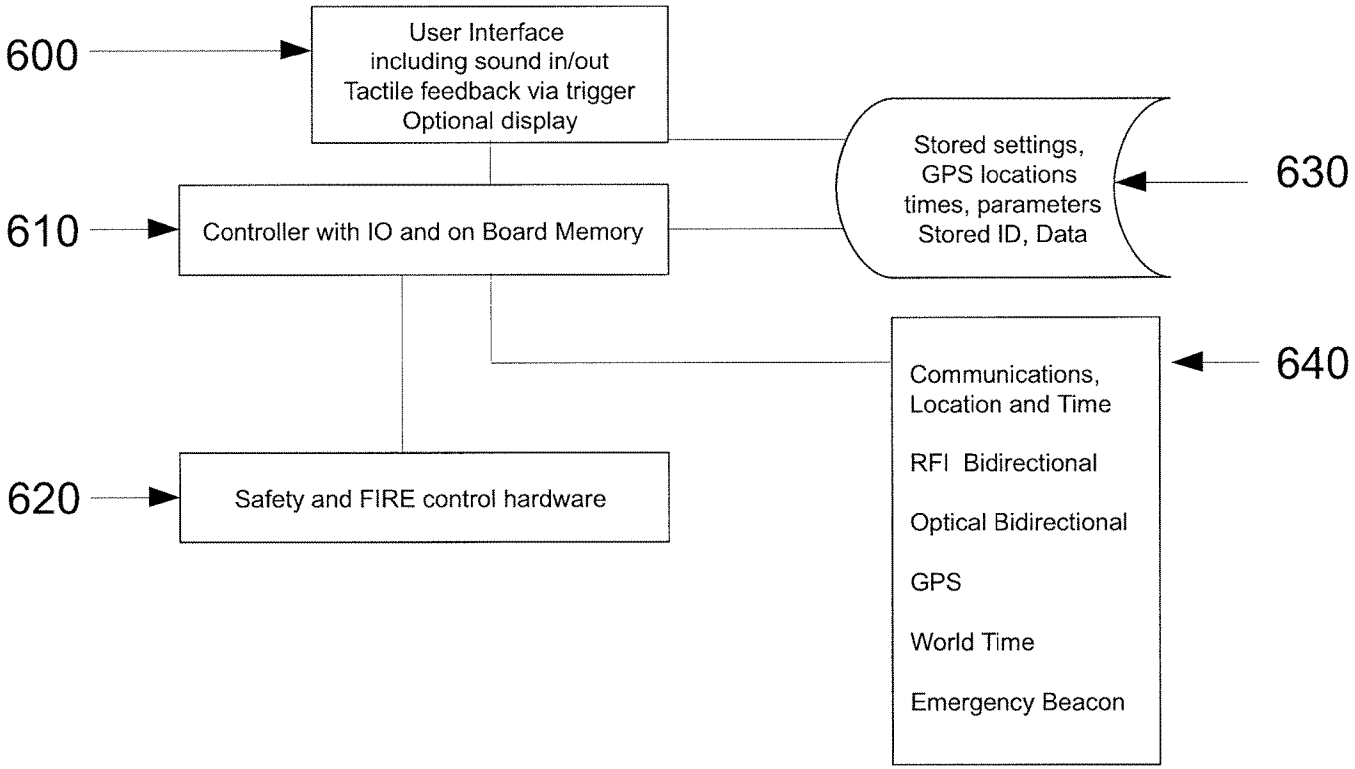
FIG. 6 is a view of a microcontroller, main memory with information including restricted no fire areas and times, optional data display, sound input and output and fire control hardware according to an embodiment of the present invention.

FIG. 6 shows the operational logic blocks used in the preferred embodiment. The microcontroller 610 and User Interface 600 which includes tactile feedback, sound in and out and an optional data display both interact with the main memory 630 to record each shot with a time and pointing direction and full GPS location. The final functional block 620 is where the microcontroller 610 send control information to fire or go to safe mode.

In operation, a force sensing trigger 400, which may include a piezoelectric 410 or piezoresistive element is pressed and changes output voltage or resistance as a function of the applied pressure, one or more times in an activation sequence. The activation sequence includes a specific pattern of pressures or pulses on the trigger 400, and the pattern may be defined by reference to a relative duration of the pulses and/or relative force on the trigger as a function of time. In addition in the preferred embodiment one or more voice commands can be sensed by one or more microphones 486. The activation sequence or owners recognition code is advantageously preprogrammed by the user, e.g., upon purchasing the firearm, and stored in memory in control logic 420-480.

When trigger 400 is operated, signals representing the force as a function of time are transmitted to control logic section 420, and thence to 430 which compares them to the activation sequence, with the firearm becoming usable only when the trigger operations match the preprogrammed activation sequence and is sent to logic in 440 and 450. Finally the arm is fired, after a second check of owner recognition at 460, by the action of electromechanical elements at 490 which release a spring loaded firing pin, or hammer.

Alternatively, the firing pin may be part of a solenoid and be electrically actuated. In yet another embodiment the ignition may be initiated by an electrical current for example causing thin magnesium wire to vaporize thus setting off the primer material or with sufficient flash magnesium wire the gunpowder directly. One or more program controlled safeties are turned to on or Safe position if the arm is not fired and a preset time has elapsed 470. 470 also treats the use of the GPS sensor to determine the position and orientation of the firearm along with the time and compare that time and location to a table of restricted GPS locations. In addition as shown in 530 FIG. 5 actual Global Positioning (GPS) coordinates and World time is compared to one or more tables of locations stored in memory 540, each coordinate has one or more parameters indicating the area around the stored table coordinate which is restricted and the Greenwich Mean time range if any when the restriction is lifted.

In addition to the restricted areas (if any) there are also owner defined locations which are entirely unrestricted. As an example one table of GPS coordinates parameters and times in one embodiment will be all the schools, malls, hospitals, doctors offices, clinics and theatres in North America. Based on the 2010 school count in the U.S. of 98,817 public schools the total estimate for North America is 950,000 such sites. Each site will require 200 bytes of information including the site location, time of restriction, a described polygon which includes any legally required distance for firearms creating the need for 190 megabytes of memory space for such or far less memory then is commonly used in most low cost electronic devices today. In one embodiment the arm will also note when the weapon is pointed at a restricted region and prevent firing if the range to the restricted area is smaller than the range for the cartridge used in the firearm.

The activation sequence acts as a "password" with both or either voice and trigger pressure to prevent the firearm from being used by anyone other than an authorized user. After the owner is recognized the trigger pull and one or more stages of pull may be set 480 by putting in the trigger set sequence, followed by the number of stages (1 to 4) the trigger will then vibrate to indicate the stage and the owner then simply presses the trigger to set the force to fire (last stage) or to move to the next stage, note that when in these setting sequences the safety is always on and firing is fully inhibited. If the activation sequence is not recognized then logic in 440 commands the drivers in 450 to flash the safety LED, if recognized the LED is steady but in both cases the safety is set and must be release by the shooter.

In an additional embodiment programmable logic in 480 in conjunction with sensors in the magazine or on the frame of a revolver looking in the chambers not in battery permits the arm to notice ammo out, remaining ammo or last round as trigger back pressure giving notice to the shooter. Also LED flash and LED steady may be replaced by a vibration or series of vibrations indicating that the safety is on, that is fed back to the trigger finger. Thus if password enabled every time the trigger is pressed when the safety is on, the signal of safety on is sent to the finger.

In a further embodiment the mechanical safety which blocks the firing pin of the weapon must be cycled on and then off (ready to fire) before the weapon will fire for the first time after the owners code is entered. The position of the mechanical safety is detected optically or electronically and the resultant electronic signal is sent to the logic of the electronic recognition trigger. In an additional embodiment the trigger is vibrated to indicate a safe state (safety on firing disabled) for an preset (but programmable) time after the arm is enabled and in the dark (as sensed by a phototransistor). In yet another embodiment, the safety display may be any combination of passive mechanical, electrophoretic, liquid crystal, OLED, electroluminescent and LED displays. In an alternate embodiment displays and/or speaker 484 are used to report the GPS position and with the display the nearest known roads. In an alternative embodiment microphones and trigger can be used to select the emergency beacon 484 or transmitter 580 function in those firearms, typically rifles, where antenna and adequate power is available from batteries, supercaps, and small stock mounted solar panels.

In operation then in FIG. 6 the system uses logic provided by a programmed microcontroller 610, initiated and reporting through a User Interface 600 which makes commands through trigger pressure and voice to the controller 610 and based on the proper activation sequence the controller enables firing of the weapon. The controller uses information provided by the sensors including GPS, World time, and can bidirectionally communicate via RF or Optical links to nearby devices and networks. Information about settings and nearby GPS and Time restrictions are loaded from 630 by the controller 610. When all conditions are met the controller 610 can command the Fire control hardware to permit the safety to be set to off and can, when the trigger is pressed to the preset force for the final stage (there will be at least 1 stage for firing the gun), fire a round from the firearm.

In use the cartridge of FIG. 1 is a molded plastic part or in an alternative embodiment partially plastic part with special material (such as brass, steel or high stiffness engineering plastic) head (as at 360 FIG. 3) that includes the primer recess 370 and extraction groove (recess between the arrow from 360 and that from 350 that goes completely around the case head or base, the end of the cartridge case in which the primer is placed and cartridge extraction is made). The extended or elongated flash tube 110 is molded in along with one or more stabilizing ribs or connections 120 ending short of the case mouth 130.

In an alternative embodiment the connections, webs or ribs 390 FIG. 3 are molded so as to act as lower stops for the projectile or bullet in the cartridge case. The flash tube 110 and rib(s) or web or connection 120 may be molded or made as a part of the separate head (base) 360 when such two piece construction is made or alternatively molded in one piece as part of the case forward of the head (base) as in 100. The ignition flash tube 110 brings the confined ignition gases produced by the primer (primer pocket shown at 370) to the front of the cartridge case 300 FIG. 3 to ignite the powder so that it burns from just below the bullet (as in 340 FIG. 3) to the back of the case toward the head 100.

The plastic molding is made with a projectile 340 FIG. 3, the lower portion of which, located at neck of the cartridge case may also have a recess to lock on the as molded cartridge casing. The projectile forms the forward end of the cartridge case. The molding process can incorporate a core pull which with a portion of the projectile 340 FIG. 3 define an interior volume of the plastic cartridge casing body including an elongated flash tube 110 and at least one molded connection 120 or web to the inner wall of the molded casing. The webbing or connection 120 may be extended to act as a mechanical stop 390 FIG. 3 to prevent rearward motion of the projectile 340 FIG. 3. The core pull may in its portion immediately below the projectile but still in the neck of the cartridge case forward of the web 120 be of smaller diameter so as to further prevent movement of the projectile into the cartridge case.

In operation FIG. 2 is a cartridge case 100 embodiment with a plastic molded extended flash tube 110. The flash tube 110 is stabilized by one or more webbings, ribs or connections 120 which in this embodiment only extend part way down the case toward the cartridge case head 360. The flash tube 110 has a (one or more petals) valve 230, 270 that opens out under the pressure of ignition gases, but otherwise remains closed and insures that the flash tube does not partially or completely fill with powder. In an alternative embodiment a rapid burning or explosive material may fill or cover the end of the flash tube 110 FIG. 1 so as to further promote and insure rapid and complete ignition of the gunpowder.

An additional embodiment is the filler liquid, reservoir and delivery tube (all three labeled 240) from which the lower portion of the cartridge case (when mounted upright) may be filled with an appropriate material such as urethane foam in order to create a reduced powder capacity useful in squib and sub-sonic loads. In a further related embodiment the filler material is hydrated or composed of a material subject to partial or full decomposition or chemical reaction slower than the powder burn to a mostly inert gas under the pressure and heat generated by the powder burn such that the resultant gas backs up or maintains or even increases and sustains the gas operated cycling of the action to eject the spent cartridge and load the firearm after the projectile 340 FIG. 3 leaves the muzzle. If the filler is hydrated the gas could include steam. The filler may be layered (from the head toward the case mouth) and its composition varied by layer so as to time the release and the volume of released gas according to the needs of the specific arm, or family of arms.

Yet another embodiment in FIG. 2 is the insert flash tube 260 with two or more flexible disks 250 and 252. 250 is a continuous disk (no holes or passages) attached to the flash tube 110 and designed to reach the bottom of the case and guide the flash tube into the flash hole 380 (FIG. 3) above the primer in the pocket 370. The second disk 252 has openings to permit either powder or filler 240 placed between the disks. Thus this embodiment permits any existing cartridge case to be converted to frontal ignition either as a full powder load or a squib or sub-sonic load while maintaining the optimal powder volume for the load. Additionally the flash tube end closure 230 can be built into flash tube as at 270.

In operation the molded cartridge case in FIG. 3 300 may be entirely molded material including plastic or alternatively in 345 incorporate molded, ultrasonically welded, thermally bonded, or adhesively bonded in elements such as the metal head 360, with primer pocket 370, and flash hole 380. Molding in the metal part along the plastic mold line 350 joins the metal head to cartridge body, while presenting a high strength extractor lip in the metal head 360 to the extraction mechanism. 300 and 345 are both reduced powder charge cartridges particularly well suited to squib or sub-sonic reduced power, noise, and muzzle flash. Muzzle flash and noise are further reduced by use of the extended flash tube 310 which causes the powder to burn from the base of the bullet 340 back toward the head 360. The powder reduction Head 360 with the primer cup 370 and the flash hole 380 located more or less in the region bounded by the dashed line 350 constitute the head of any cartridge and the term head applies, along with bullet 340, to all cartridge drawings in the specification.

While the invention has been described with respect to specific embodiments, one skilled in the art will recognize that numerous modifications are possible. One skilled in the art will also recognize that the present invention provides a number of advantageous techniques, tools, and products, usable individually or in various combinations. These techniques, tools, and products include but are not limited to:

- a cartridge case molding method for a continuous injection molding of a case with one or more core pulling elements or core pulls such that an extended or elongated flash tube is created which conducts primer sourced ignition gases so as to initiate powder located just under the projectile burning from the front of the cartridge below the projectile toward the rear of cartridge case or head; and/or
- a cartridge case with primer, gunpowder and a projectile which is molded from plastic and has an extended or elongated flash tube with molded in support to the inner case wall; and/or a cartridge case with primer, gunpowder and a projectile which is molded from plastic with a metal or high performance plastic head adhesively attached to the rest of the case, head carrying the extraction groove, primer cup and primer and flash hole and has an extended or elongated flash tube with molded in support to the inner case wall; and/or a cartridge case with primer, gunpowder and a projectile which is molded from plastic with a metal or high performance plastic head ultrasonically attached to the rest of the case, head carrying the extraction groove, primer cup and primer and flash hole and has an extended or elongated flash tube with molded in support to the inner case wall; and/or a cartridge case with primer, gunpowder and a projectile which is molded from plastic with a metal or high performance plastic head thermally bonded to the rest of the case, head carrying the extraction groove, primer cup and primer and flash hole and has an extended or elongated flash tube with molded in support to the inner case wall; and/or a flash tube assembly with stabilizing flexible supports that extends the flash tube forward from the rear flash hole to a region close to the base of the projectile, which can be inserted through the neck of any cartridge case so as to provide frontal ignition of the gunpowder; and/or a cartridge case molded such that the cartridge internal volume for gun powder is substantially smaller than the design volume; and/or a cartridge case filled with a material such that the cartridge internal volume for gun powder is substantially smaller than the design volume; and/or a cartridge case filled with a material evenly from the head or primer end of the cartridge case toward the projectile end of the case such that the cartridge internal volume for gun powder is substantially smaller than the design volume and this material ignites and is slower burning then the gunpowder and gives off gases to operate the firearm even after the projectile has left the muzzle; and/or a cartridge case filled with a series of layers of material from the head or primer end of the cartridge case toward the projectile end of the case such that the cartridge internal volume for gun powder is substantially smaller than the design volume and this material ignites and is slower burning then the gunpowder and gives off gases to operate the firearm even after the projectile has left the muzzle such that the portions toward the rear or primer end give off more gas per volume of material then those layers nearer the projectile end; and/or a firearm controlled by a pressure or force sensitive trigger; and/or a firearm in which a particular time series of pressures on the trigger (which may be varying or non-varying pressures) and/or voice commands causes a particular action including but not limited to making the arm operational for firing; and/or a firearm in which a particular time series of pressures on the trigger (which may be varying or non-varying pressures) and/or voice commands causes a particular action, including but not limited to setting the trigger pressure and/or setting any other parameters and/or determining the GPS location and Greenwich Mean Time of the weapon, and wherein the trigger pressure and/or other parameters and/or the GPS location and/or the Greenwich Mean Time is spoken and/or displayed on an attached digital display; and/or a firearm in which the actual GPS location and time are compared to a data base of such locations and proscribed distances, time and the operational range of the firearm at the location including altitude is made and firing is disabled until such time as either the firearm is outside the latter calculated area, time of allowed firing is found to correspond to the actual time or a location is reached in which operation of the firearm is enabled; and/or a firearm in which each shot includes a captured shot sound which is recorded with time stamp, and firearm direction and location; and/or a firearm in which an emergency beacon is built in and can be turned on by trigger pressure sequence and/or by voice command; and/or a firearm in which bidirectional links permit the status and location of the arm to be set and queried over Radio Frequency and Optical links including WiFi, cell phone systems, Blue Tooth and Wide Area Networks; and/or a firearm in which the trigger pressure and number of stages of trigger can be set via trigger sequence, voice or communication input; and/or a firearm that measures temperature and wind (direction and force) and displays them or says them to the user.

Thus, although the invention has been described with respect to specific embodiments, it will be appreciated that the invention is intended to cover all modifications and equivalents within the scope of the following claims.

What is claimed is:

1. An ammunition article comprising:

a projectile;

a tubular cartridge casing that includes, a base having a flash hole, an injection-molded tubular plastic cartridge casing body having a portion formed around at least a portion of the projectile, the tubular plastic cartridge casing body including an interior wall and an integrally molded elongated flash tube spaced apart from the interior wall, the elongated flash tube having a support web connected to the casing body interior wall such that the elongated flash tube is in coaxial alignment with the interior wall and fits into the flash hole in the base, the casing body having a first end closed only by the projectile and a second end.

2. The ammunition article of claim 1, wherein:

the plastic is molded around a core pull such that the core pull and the portion of the projectile define an interior volume of the plastic cartridge casing body including the elongated flash tube, and the core pull is subsequently removed from the plastic cartridge casing body.

3. The ammunition article of claim 2, wherein the core pull has a smaller diameter than the portion of the projectile.

4. The ammunition article of claim 1, wherein the plastic is molded around the portion of the projectile such that:

the plastic enters a recess in the portion of the projectile and in conjunction with one or more ribs molded as part of the support web, forms a flange.

5. The ammunition article of claim 1, and further comprising a base attached to the second end of the cartridge casing body.

6. The ammunition article of claim 5, and further comprising a propellant charge inside the space between the interior wall and the elongated flash tube.

7. The ammunition article of claim 6, and further comprising a primer disposed at the base for igniting the propellant charge.

8. The ammunition article of claim 5, wherein the cartridge casing propellant volume is reduced by molding a reduced cartridge interior.

9. The ammunition article of claim 5, wherein:

the base is mechanically attached to the cartridge casing body; and a flash hole in the base is positioned to couple to the elongated flash tube.

10. The ammunition article of claim 5, wherein the base is attached to the cartridge casing body by adhesive joining.

11. The ammunition article of claim 5, wherein the base is attached to the cartridge casing body by heat bonding.

12. The ammunition article of claim 5, wherein the base is attached to the cartridge casing body by ultrasonic welding.

13. A method of making an ammunition article, comprising the steps of:

injection molding plastic around at least a portion of a projectile while a core pull contacts a bottom end of the projectile to form a plastic cartridge casing body having an interior wall and an integrally molded elongated flash tube spaced apart from the interior wall, the integrally molded elongated flash tube having a support web connected to the interior wall and holding the flash tube in coaxial alignment with the interior wall, the plastic cartridge casing body having a first end to which the projectile is attached and a second end.

14. A method of making an ammunition article, the method comprising the steps of:

injection molding plastic around at least a portion of a one-piece projectile to form a cartridge casing body with a cartridge case wall and an integrally molded elongated flash tube with at least rib connecting the integrally molded elongated flash tube to the cartridge case wall, the cartridge casing body having:

a first end to which the projectile is attached such that the projectile is separable from the cartridge casing body upon application of a bullet pull above a first value and such that the projectile does not require for separation a bullet pull above a second value, and a second end, the cartridge casing body being in the form of an open tube between the first end and the second end, the first end being closed only by the projectile.

15. A method of making an ammunition article, the method comprising the steps of:

injection molding plastic around at least a portion of a projectile to form a tubular plastic cartridge casing body including a case interior wall and an elongated flash tube having at least one integral rib connecting the elongated flash tube to the case interior wall, the plastic cartridge casing body having a first end closed only by the projectile and a second end; and providing a base having a flash hole at the second end of the plastic cartridge casing body such that the elongated flash tube is centered relative to the projectile and fits into the flash hole in the base.

16. The method as set forth in claim 15, wherein:

the plastic is molded around a core pull such that the core pull and the portion of the projectile define an interior volume of the plastic cartridge casing body including the elongated flash tube and the at least one rib, the method further comprising the step of removing the core pull from the plastic cartridge casing body subsequently to the injection molding.

17. The method as set forth in claim 16, wherein the core pull has a smaller diameter than the portion of the projectile such that the interior volume of the cartridge casing body includes:

a first interior portion defined by the portion of the projectile, the first interior portion having a first diameter; and a second interior portion having a second diameter smaller than the first diameter; and wherein the at least one rib engages the projectile to prevent axial movement of the projectile into the second interior portion.

18. The method as set forth in claim 13, wherein the step of injection molding the plastic includes forming a base at the second end of the plastic cartridge casing body, the base including a recess to hold a primer material.

19. The method as set forth in claim 13 and further comprising:

attaching a base at the second end of the plastic cartridge casing body, the base including a recess to hold a primer material.

20. The method as set forth in claim 13 and further comprising:

filling at least a portion of a space between the integrally molded elongated flash tube and the plastic cartridge casing body with a propellant charge.

21. The method as set forth in claim 13, wherein the support web includes at least one rib near the first end and extending partway toward the second end.

* * * * *